US007347581B2

(12) United States Patent
Krieger

(10) Patent No.: US 7,347,581 B2
(45) Date of Patent: Mar. 25, 2008

(54) MULTI-BEAM FLASHLIGHT

(75) Inventor: Michael Krieger, Miami Beach, FL (US)

(73) Assignee: Vector Products, Inc., Ft. Lauderdale, FL (US)

( * ) Notice: Subject to any disclaimer, the term of this patent is extended or adjusted under 35 U.S.C. 154(b) by 34 days.

(21) Appl. No.: 11/098,418

(22) Filed: Apr. 5, 2005

(65) Prior Publication Data

US 2005/0237734 A1 Oct. 27, 2005

Related U.S. Application Data

(63) Continuation of application No. 10/845,520, filed on May 14, 2004, which is a continuation-in-part of application No. 10/609,537, filed on Jul. 1, 2003, now abandoned.

(51) Int. Cl.
*F21L 4/02* (2006.01)
*F21L 4/08* (2006.01)

(52) U.S. Cl. ..... 362/183; 362/184; 362/202; 320/114; 320/115

(58) Field of Classification Search ..... 320/111, 320/114, 115; 362/183, 184, 205, 208, 251, 362/253
See application file for complete search history.

(56) References Cited

U.S. PATENT DOCUMENTS

| | | | | |
|---|---|---|---|---|
| 1,946,059 | A | 2/1934 | Buchholz | |
| 2,389,762 | A | 11/1945 | Burke | |
| 2,863,038 | A | 12/1958 | Lombardo | |
| 3,217,156 | A | 11/1965 | Sherwood | |
| 3,233,091 | A | 2/1966 | Hunt | |
| 3,591,796 | A | 7/1971 | Barker | |
| 4,001,803 | A | 1/1977 | Lombardo | |
| 4,177,500 | A | 12/1979 | Nicholl et al. | |
| 4,214,185 | A | 7/1980 | Breeze | |
| 4,563,629 | A * | 1/1986 | Keiper | 320/134 |
| 4,590,543 | A * | 5/1986 | Chen | 362/183 |
| 4,603,953 | A * | 8/1986 | Watanabe | 396/201 |
| 4,962,347 | A * | 10/1990 | Burroughs et al. | 320/114 |
| 4,963,798 | A | 10/1990 | McDermott | |
| D348,942 | S | 7/1994 | Yuen | |
| D350,407 | S | 9/1994 | Yuen | |
| 5,428,514 | A | 6/1995 | Fink | |
| 5,432,689 | A * | 7/1995 | Sharrah et al. | 362/183 |
| 5,467,258 | A | 11/1995 | Bamber et al. | |
| 5,685,637 | A | 11/1997 | Chapman et al. | |
| 5,743,628 | A | 4/1998 | Greif et al. | |
| D414,576 | S | 9/1999 | Yuen | |
| 5,963,140 | A * | 10/1999 | Kawaguchi et al. | 340/815.58 |
| 5,984,494 | A | 11/1999 | Chapman et al. | |
| RE36,696 | E | 5/2000 | Blackman | |
| D426,006 | S | 5/2000 | Yuen | |
| 6,179,431 | B1 | 1/2001 | Chien | |
| 6,184,794 | B1 * | 2/2001 | Tucholski | 340/636.14 |
| 6,280,049 | B1 | 8/2001 | Tam | |

(Continued)

*Primary Examiner*—Thomas M. Sember
(74) *Attorney, Agent, or Firm*—Venable, LLP; Jeffri A. Kaminski

(57) ABSTRACT

A flashlight is provided. The flashlight includes a housing having a first end and a second end. A first light source is disposed at the first end of the housing. A second light source is disposed at the second end of the housing. A battery is disposed in the housing. A selector selectively couples the first light source and the second light source to the battery.

21 Claims, 13 Drawing Sheets

U.S. PATENT DOCUMENTS 6,280,053 B1 8/2001 Chien
6,316,911 B1 * 11/2001 Moskowitz et al. ..... 320/114
D455,513 S 4/2002 Galli
6,388,390 B2 5/2002 Rachwal
6,623,140 B2 * 9/2003 Watterson et al. ..... 362/184
D481,675 S * 11/2003 Ng ..... D13/108
6,808,287 B2 * 10/2004 Lebens et al. ..... 362/184
6,909,260 B2 * 6/2005 Parker ..... 320/107
2002/0191396 A1 12/2002 Reiff et al.
2003/0067767 A1 * 4/2003 Liu ..... 362/183
2003/0067769 A1 * 4/2003 Gilpin ..... 362/184
2003/0128547 A1 * 7/2003 Shoji ..... 362/475
2003/0223227 A1 * 12/2003 Levine ..... 362/183
2004/0105273 A1 * 6/2004 Takeda ..... 362/473
2004/0264181 A1 * 12/2004 Woolfson ..... 362/157

* cited by examiner

MULTI-BEAM FLASHLIGHT

CROSS-REFERENCE TO RELATED APPLICATIONS

This Application is a continuation of U.S. Ser. No. 10/845,520, filed May 14, 2004, which claims priority of a continuation in part application Ser. No. 10/609,537 filed Jul. 1, 2003 now abandoned.

BACKGROUND OF THE INVENTION

1. Field of the Invention

The present invention relates generally to flashlights and more particularly to multi-function flashlights and a controller for multi-function flashlights and other light sources.

2. Related Art

Flashlights, and especially hand-held flashlights are used in many instances as first sources of light in locations which are situated too far for the use of light sources connected to an electric power distribution network, or in which locations the distribution network has failed. Flashlights typically provide only a single light source. As such, these flashlights only have one mode of operation. Frequently these flashlights, and especially the flashlights designated for emergency use only, are stored away for long time periods between activations.

Common batteries used in these flashlights have a limited shelf life. After a relatively short time period has elapsed, these batteries are discharged even if they are not used. After storage or use for an extended period of time, the battery for the flashlight may not have enough power to illuminate the single light source. However, the battery may not be totally discharged and may have enough power to illuminate lower power consumption light sources, such as Light Emitting Diodes (LEDs).

Even if rechargeable batteries are used, a user has no way of knowing how much charge remains on the batteries or how long the flashlight can be used on its current charge. Also, in many instances, the single light source of may be inadequate for a situation, for example, the light may be too bright, not bright enough, etc.

Thus, there is a need for a multi-function flashlight that overcomes the above-described problems. Such a flashlight would desirably include different light sources that can be used in different situations. It would additionally be desirable for a user to be able to monitor the status of the power supply of the flashlight. It would further be desirable to extend the life of a power supply by selectively switching among different light sources, each of which require different amounts of power.

SUMMARY OF THE INVENTION

According to an exemplary embodiment of the invention, a flashlight is provided that comprises a housing supporting a plurality of light sources. A power supply is disposed in the housing and is selectively couplable to the light sources. A selector selects selected ones or combinations of the light sources for illumination. A controller controls the coupling of the power supply to the selected light sources and determines a remaining operation time of the flashlight based on a charge of the power supply and the selected light sources. A display is arranged on the housing and controlled by the controller to display the remaining operation time.

In another exemplary embodiment of the invention, a method for controlling operation of the flashlight is provided. The method comprises receiving a signal from the selector at the controller. A mode of operation is determined with the controller based on the signal from the selector. Individual ones or combinations of the light sources are selectively coupled to the power supply based on the mode of operation. A remaining operation time is determined based on a charge of the power supply and the mode of operation. The remaining operation time is shown on the display.

In another exemplary embodiment of the invention, a flashlight and cradle combination is provided. The combination comprises a flashlight including a housing having a head disposed at a first end, a second end opposite the first end, and a body adapted to contain at least one battery and arranged between the first end and the second end, a first light source disposed at the head of the housing, and a second light source disposed at the second end of the housing; and a cradle including a first end defining a generally U-shaped recess adapted to receive the first end of the housing, a second end defining a second recess adapted to receive the second end of the housing, and a central portion joining the first and second ends of the cradle.

According to another exemplary combination, there is provided a flashlight arrangement including a housing having head a disposed at a first end, a second end opposite the first end and having an contacts disposed thereon, and a body adapted to contain at least one battery and arranged between the first end and the second end, a first light source disposed at the head of the housing, a second light source disposed at the second end of the housing, and a controller for controlling the operation of the light sources; and a cradle defining a recess adapted to receive the second end of the housing, charging contacts configured to mate with the contacts on the second end of the housing, a charging circuit adapted to receive AC power input and provide a charging current to the charging contacts; wherein the controller activates the second light source when the charger is plugged into and charging the flashlight and power from the charger is subsequently interrupted.

Further objectives, advantages and benefits, as well as the structure and function of exemplary embodiments will become apparent from a consideration of the description, drawings, and examples set forth below.

BRIEF DESCRIPTION OF THE FIGURES

The foregoing and other features and advantages of the invention will be apparent from the following, more particular description of exemplary embodiments of the invention, as illustrated in the accompanying drawings wherein like reference numbers generally indicate identical, functionally similar, and/or structurally similar elements.

DETAILED DESCRIPTION OF THE INVENTION

Figure 1:
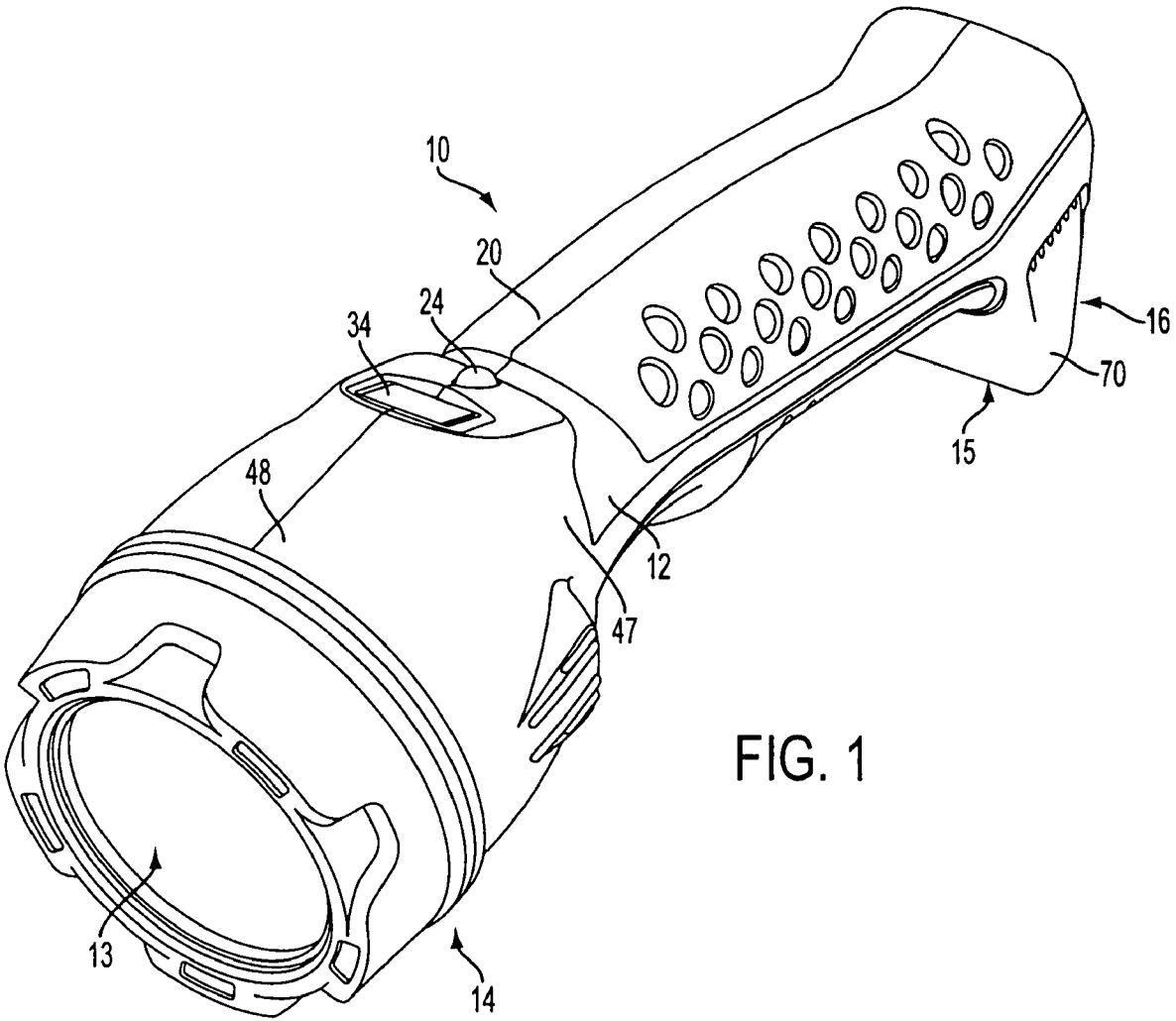
FIG. 1 depicts a perspective view of an exemplary embodiment of a flashlight according to the present invention.

Embodiments of the invention are discussed in detail below. In describing embodiments, specific terminology is employed for the sake of clarity. However, the invention is not intended to be limited to the specific terminology so selected. While specific exemplary embodiments are discussed, it should be understood that this is done for illustration purposes only. A person skilled in the relevant art will recognize that other components and configurations can be used without parting from the spirit and scope of the invention.

Referring to FIGS. 1-7, an exemplary flashlight design 10 embodying the instant invention includes a flashlight casing or housing 12 having a plurality of light sources. At least two of the light sources draw different current or have different power consumption characteristics. A first light source 13 is disposed at a first end 14 and a second light source 15 is disposed at a second end 16 of housing 12. The first light source 13 may include an incandescent, fluorescent, halogen, xenon lamp, or other light source or sources capable of producing sufficient light to illuminate an object. The second light source 15 may be comprised of LCDs, LEDs, electroluminescent panels, or other types of light sources which preferably have a significantly lower power requirement from the first light source 13.

The flashlight casing may include a generally elongate body 20 defining an interior chamber (not shown). The diameter of body 20 may be substantially constant along most of its length and be adapted to accommodate the hand of a user. Body 20 can include an outwardly tapering region 47 connected to generally cylindrically shaped portion 48, proximate end 14. Body 20 can also include an extension 70 proximate end 16 to accommodate the second light source. Although flashlight casing 12 is shown as having a generally tubular body 20, other configurations are anticipated, including rectangular, oval, square, or free form, so long as the basic components described herein can be accommodated. The components may also be arranged to suit the particular flashlight design. For the purposes of example only, the following discussion will refer to the embodiment shown in FIGS. 1-7.

The interior chamber (not shown) of body 20 is adapted to receive a power supply, such as a rechargeable battery, and other components typically associated with a flashlight. A switch assembly 24 is disposed within an opening in the body 20. Switch assembly 24 is configured to engage a circuit assembly to selectively turn the light sources of flashlight 10 ON and OFF. Switch assembly 24 may be a momentary push button switch and the circuit assembly may include an integrated circuit, such as a microprocessor or discrete circuit components. The movement of the momentary switch provides a signal to the circuit assembly to perform the appropriate electronic function. Alternatively, the switch can be a slide switch or any other type of switch. Also disposed in housing 12 is a display 34. The display may be, for example, an LED or a liquid crystal display (LCD). Various information regarding the status of the flashlight can be provided to a user via display 34, as described in more detail below.

Figure 5:
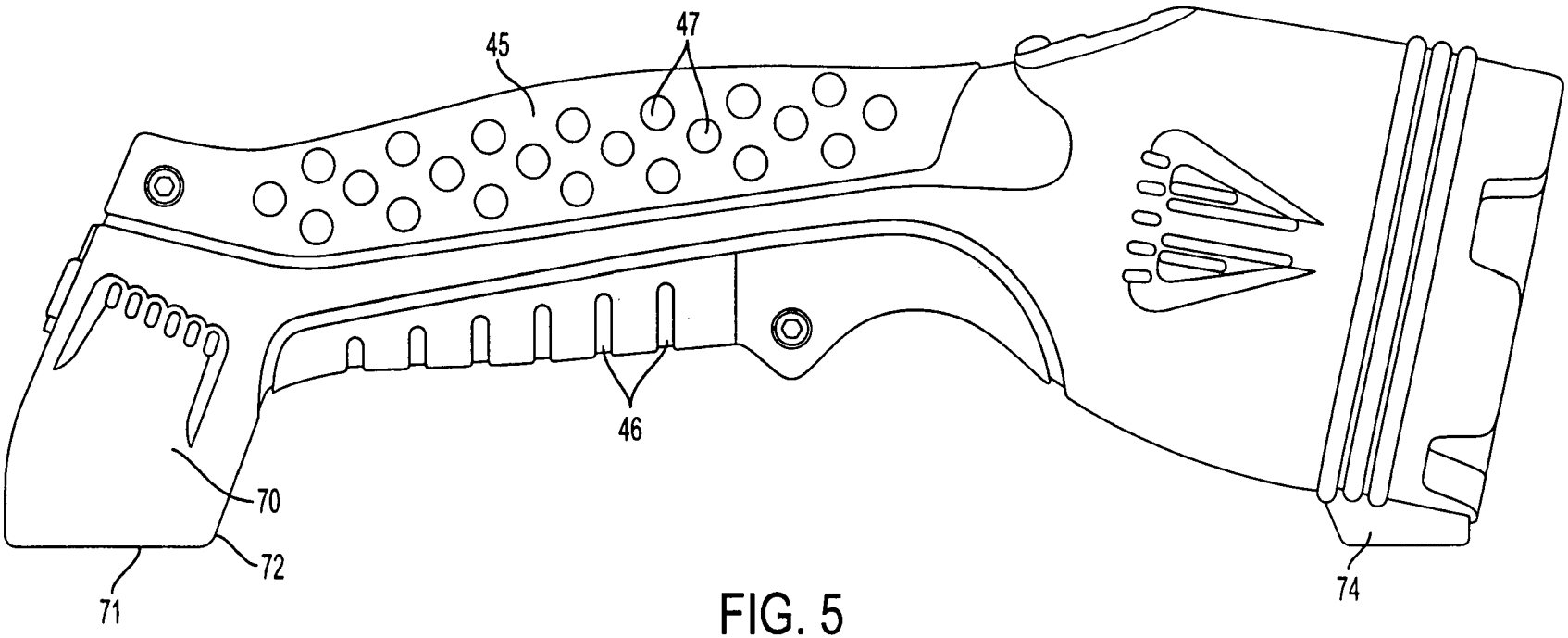
FIG. 5 depicts a side view of the flashlight shown in FIG. 1.

Housing 12 may be made from a variety of materials including machined steel, aluminum, or brass, but is preferably made from a polymeric material, such as high-impact acrylonitrile butadiene styrene (ABS) plastic or the like. An exterior surface 45 of housing 12 may also include texturing, such as stippling, channels, or other structures that improve the feel, grip and look of the flashlight. For example, as shown in FIG. 5, exterior 45 includes generally parallel channels 46 extending perpendicular to a longitudinal axis of the housing to accommodate a user's hand. Also, texturing 47 is provided on exterior 45 to help the user grip the flashlight.

Figure 4:
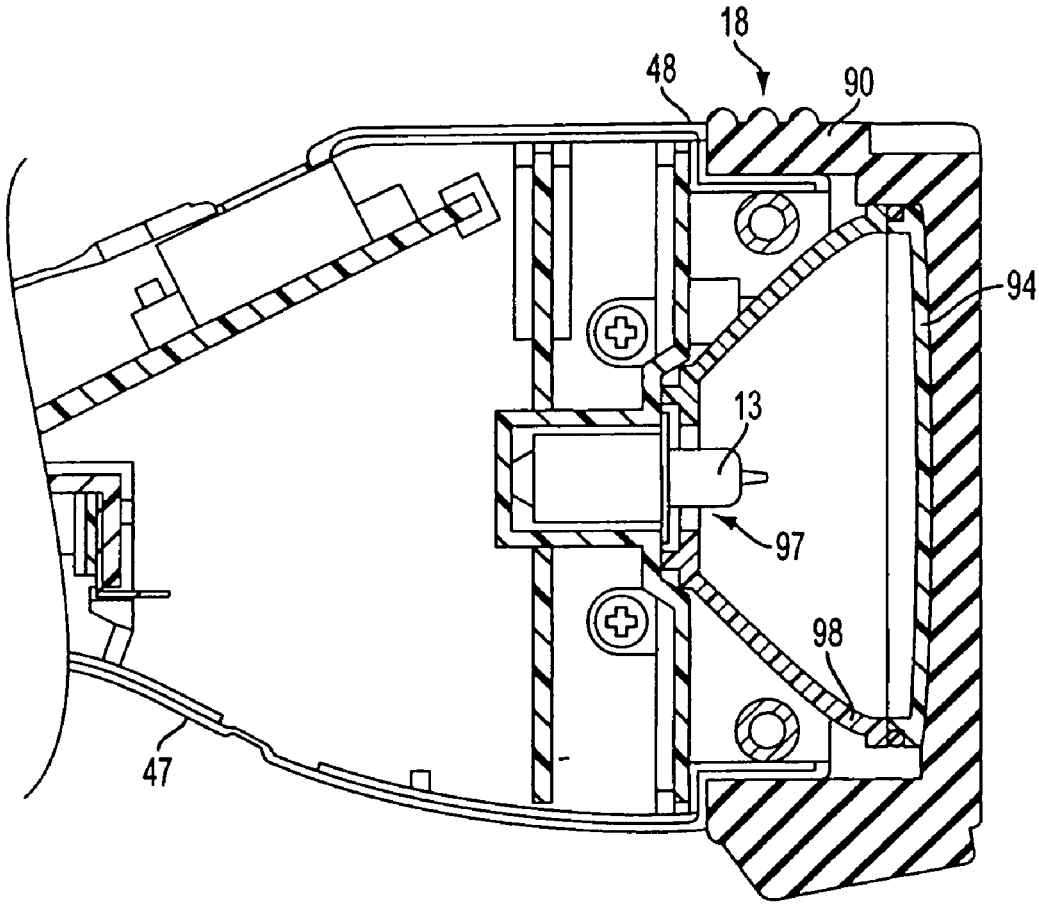
FIG. 4 depicts a cross sectional view of a front portion of the flashlight shown in FIG. 1.

In an exemplary embodiment, first light source 13 is disposed within the interior of cylindrically shaped portion 48 (FIG. 4). First light source 13 is arranged within a lens assembly 18 received at the first end 14 of the housing 12. The lens assembly 18 closes the first end 14 of the housing 12. Lens assembly 18 includes a lens ring 90. Disposed within the lens ring 90 is a polymeric or glass lens 94. Lens 94 may be configured to disperse or refract light produced by the lamp of the first light source 13 in a predetermined pattern, including a fresnel-type structure to focus the beam produced by first light source 13. Adjacent lens 94, and urging lens 94 against lens ring 90, is one edge of a reflector 98, such as commonly used in flashlight designs. The reflector includes a central opening 97 concentric with lens 94 and is configured to receive a portion of light source 13 so as to locate the light-emitting element of the light source 13 generally at a focal point of the reflector 98 so that light produced by the first light source 13 is reflected to form a beam of light emitting from the first end 14 of the flashlight.

Figure 7:
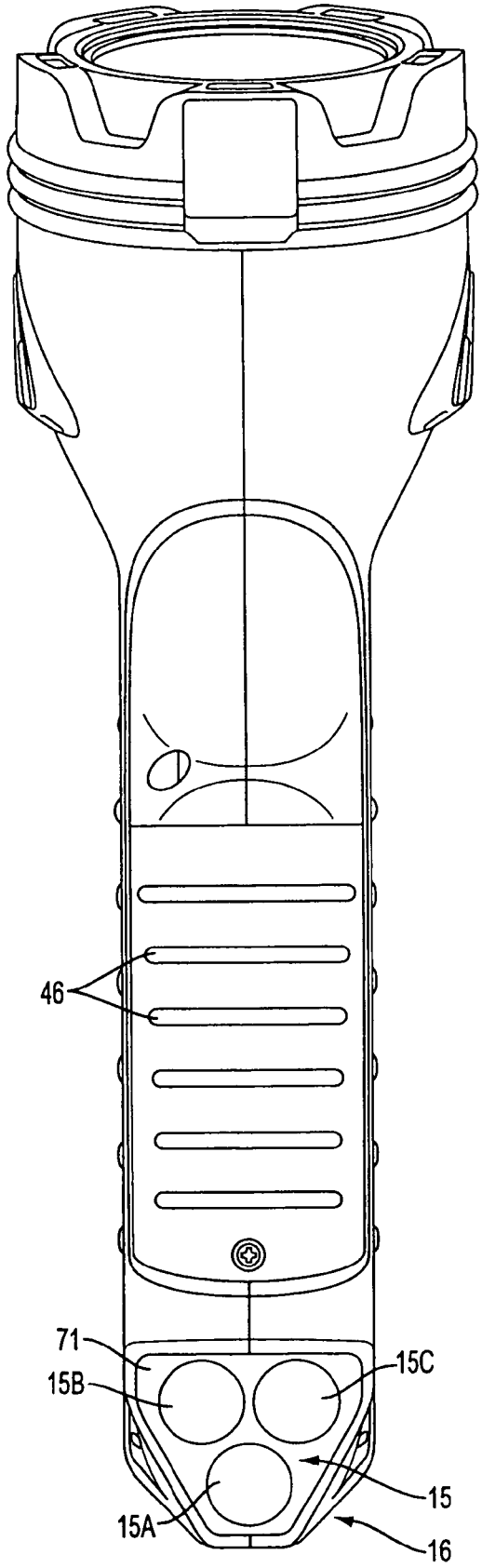
FIG. 7 depicts a bottom view the flashlight shown in FIG. 1.

As best shown in FIG. 7, the second light source 15 is disposed at the second end 16 of the housing. The second light source can be disposed in the second end 16 to project light in one or more directions. For example, second light source 15 can project its beam of light radially or substantially perpendicular to a beam of light from the first light source 13, or in the same general direction as the first light source 13. The orientation of the light beams can be accomplished in several different ways. For example, the body 20 may be angled between the first end 14 and the second end 16 such that the first end 14 and the second end 16 are offset from each other. In another embodiment of the invention, the second light source is arranged in the second end 16 of the housing to project a beam of light at an angle that is substantially perpendicular to the direction of the first light source 13. As shown in FIGS. 5 and 7, the second end 16 includes the extension 70 having a bottom face 71. The bottom face 71 of the extension 70 is arranged in a plane substantially perpendicular to a longitudinal axis of the beam of light projected by the first light source 13. An opening is formed in the bottom portion to receive the second light source 15. The second light source shown is comprised of three LEDs (not shown) covered by respective lens 15A-C.

Bottom face 71 can also be used along with a support 74 at the first end of the flashlight to support the flashlight on a surface. The support 74 is formed as a flat portion of the lens ring 18. The flashlight 10 can rest on bottom face 71 and support 74 when placed on a flat surface, such as a table.

The second light source may also be used when the lens assembly 18 is used to support the flashlight 10 on a surface. The lens assembly 18 may be placed on a surface, such as a table, such that the first light source faces the surface and the flashlight 10 is supported in an erect position. The light generated by the second light source can then be used to illuminate an area, providing a hands free light source.

Figure 6:
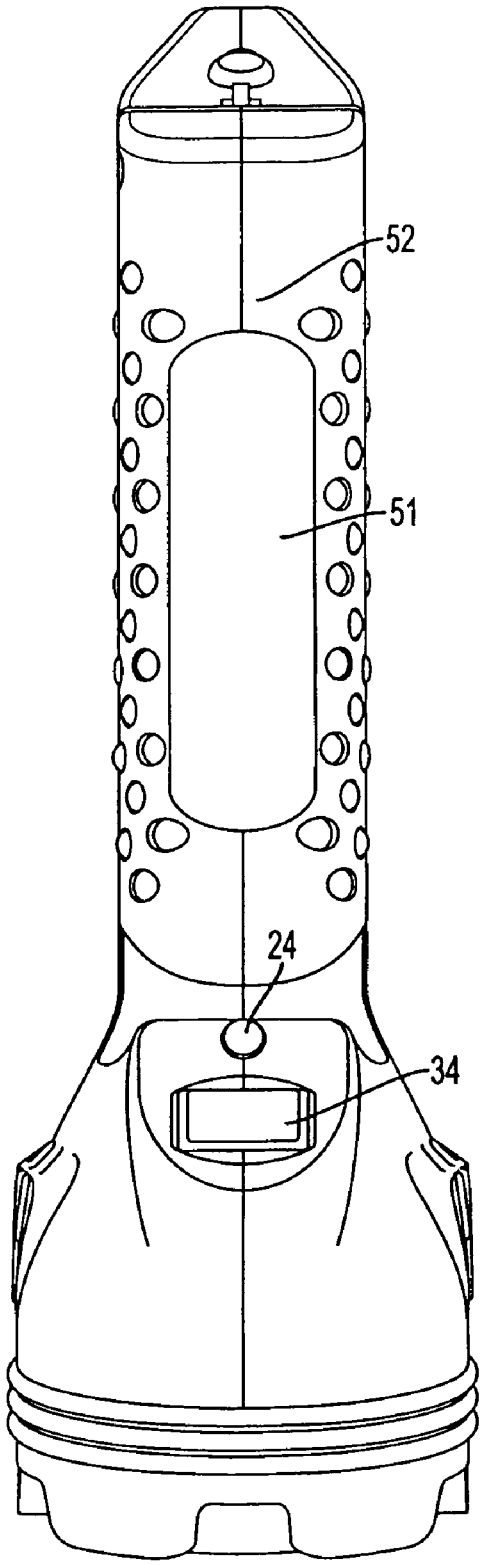
FIG. 6 depicts a modified top view of the flashlight shown in FIG. 1, in which a further light source in built into the handle.

A third light source 51 can also be provided on the flashlight. The third light source may be provided, for example, in a top surface 52 of the body 20 (FIG. 6). For example, the third light source may be a cold cathode fluorescent light (CCFL).

Figure 3:
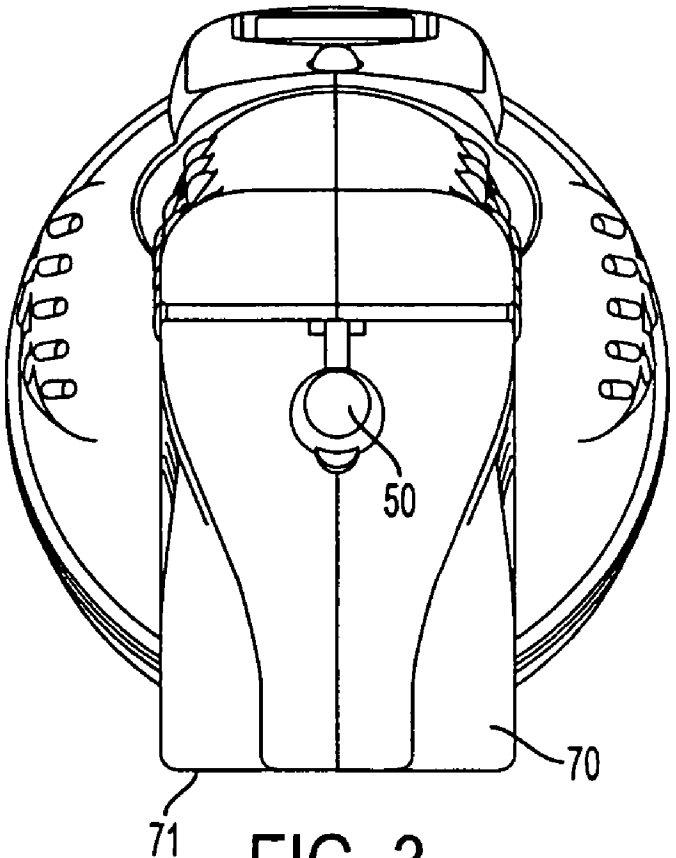
FIG. 3 depicts a rear view of the flashlight shown in FIG. 1.
Figure 2:
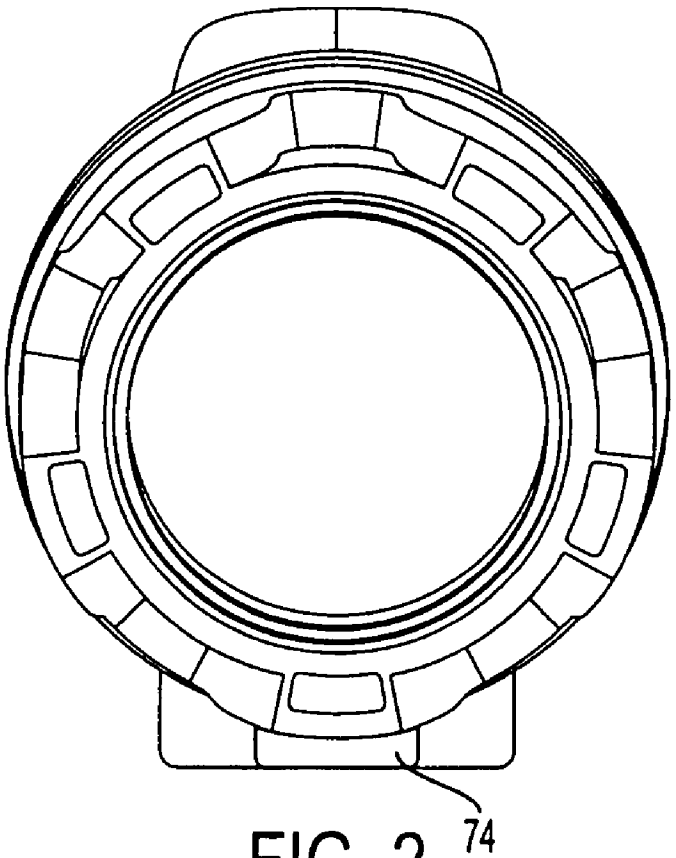
FIG. 2 depicts a front view of the flashlight shown in FIG. 1.

Flashlight 10 may include a rechargeable power supply, such as rechargeable batteries. The rechargeable batteries are housed in body 20. Housing 12 is provided with a port 50 to connect the batteries to a power supply (FIG. 3). In the embodiment illustrated, port 50 is arranged at second end 16 of the housing 12. However, any convenient position for port 50 may be employed. The port 50 may be connected to a standard wall cube for charging. Alternatively, charging circuitry can be disposed within the housing 12 and port 50 can be used for connection to a power source. Any type of charger can be used for charging the batteries for example, an AC or DC charger.

Figure 8:
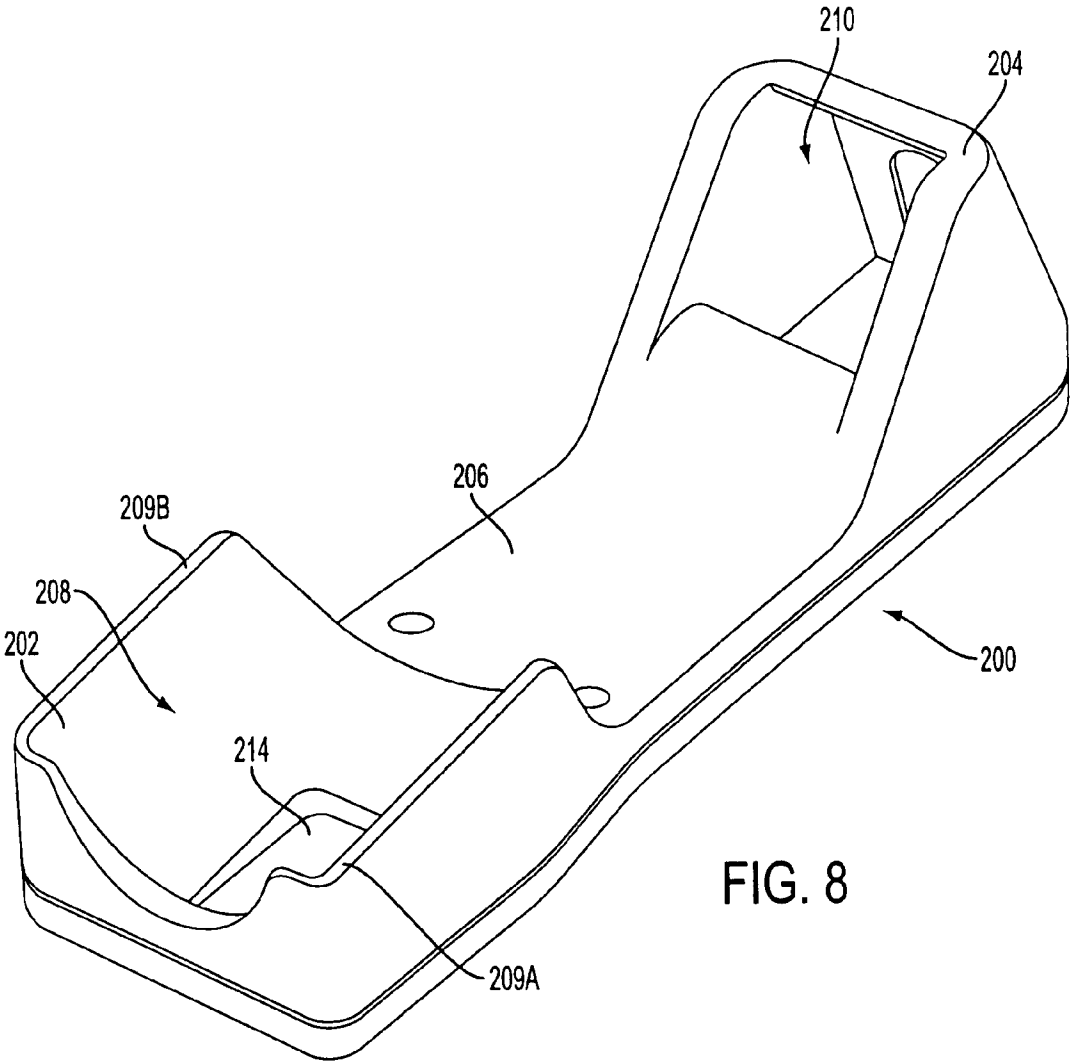
FIG. 8 depicts a perspective view of an exemplary embodiment of a cradle for use with the flashlight shown in FIG. 1 according to the present invention.
Figure 9:
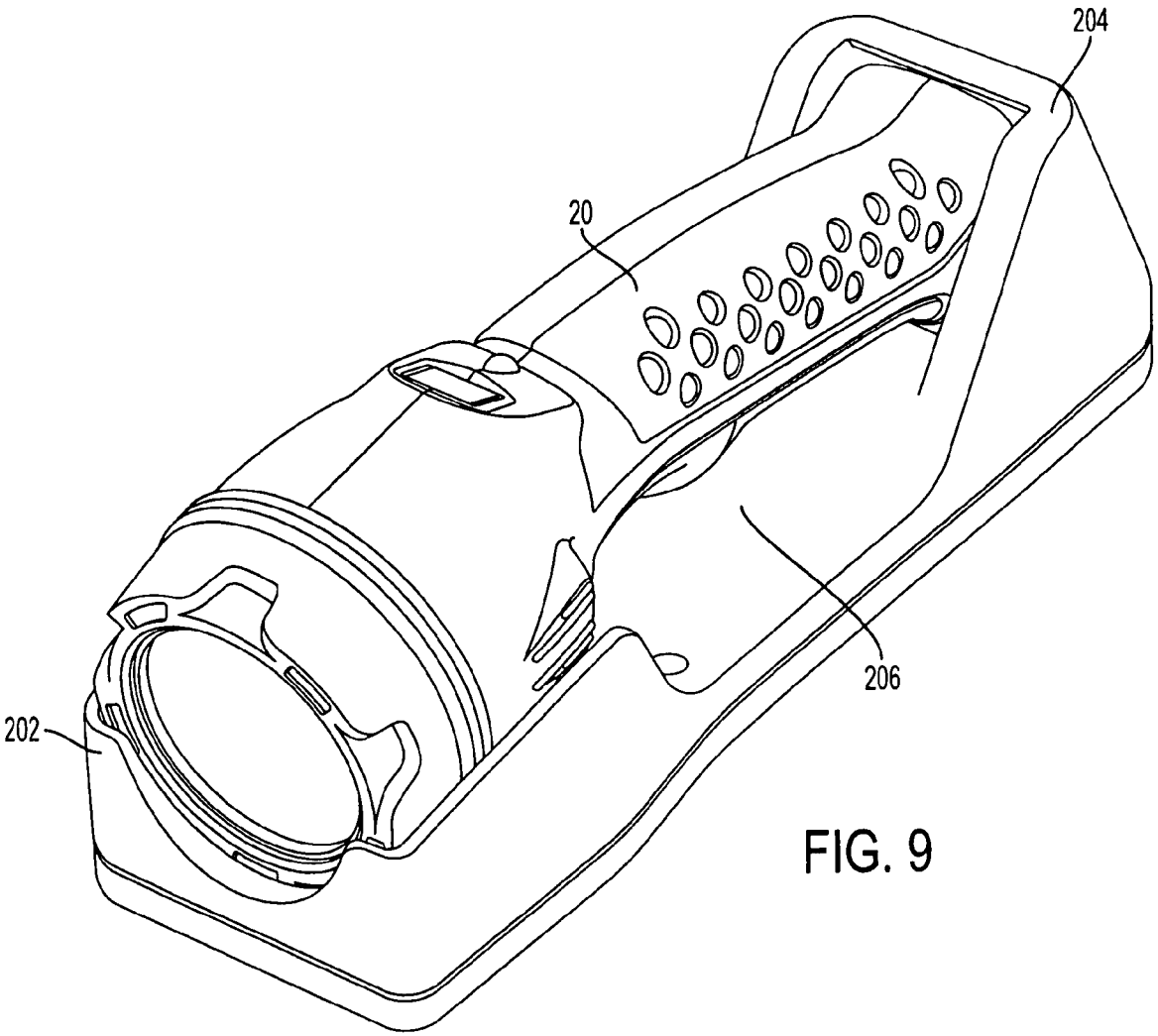
FIG. 9 depicts a perspective view of an exemplary embodiment of a combination of the flashlight depicted in FIG. 1-7 and cradle depicted in FIG. 8 according to the present invention.

A cradle can be provided to hold the flashlight when the flashlight is not in use or is being recharged. An example of a cradle 200 is illustrated in FIG. 8. The cradle 200 includes a first end 202 and a second end 204 joined together by a central panel 206. The first end 202 of the cradle 200 defines a recess 208 that is adapted to receive the first end 14 of the flashlight. The first end 202 of the cradle 200 includes two arms 209A, 209B that form a generally U shaped recess. The two arms 209A, 209B of the recess extend about one half way up the first end of the flashlight when the flashlight is resting in the cradle, as shown in FIG. 9. The top of the U shaped recess 208 is open to allow for easy insertion and removal of the flashlight from the cradle.

Figure 10:
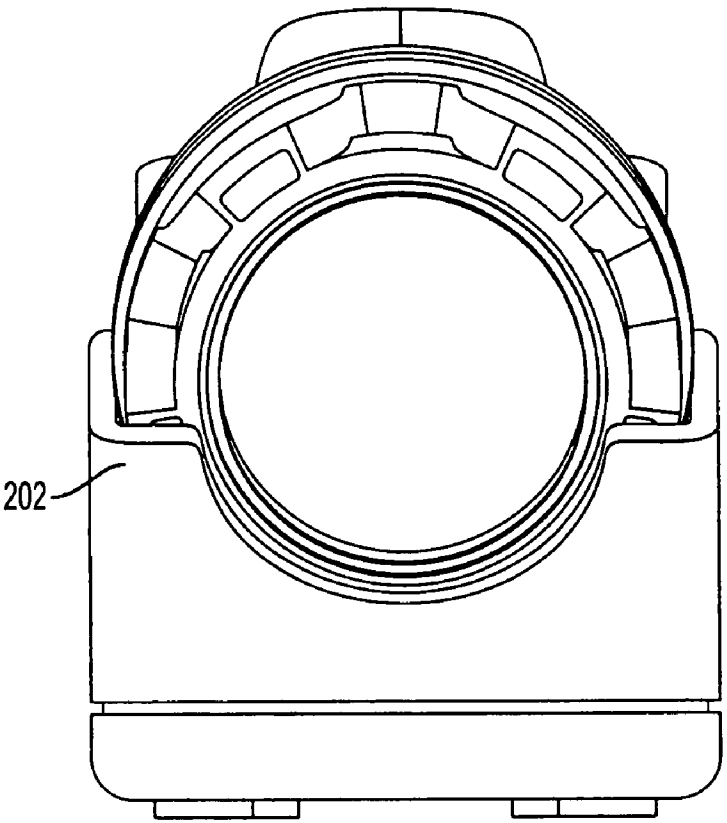
FIG. 10 depicts a front view of the combination of the flashlight and cradle shown in FIG. 9.

The second end 204 of the cradle 200 is adapted to receive the second end 16 of the flashlight. The second end 204 of the cradle 200 defines a recess 210 that is adapted to receive the extension 70 at the second end of the flashlight. The recess 210 at the second end 204 of the cradle 200 surrounds the second end 16 of the flashlight on three sides as shown in FIG. 10. The recess 210 includes an opening for insertion and removal of the second end of the flashlight into the second end 204 of the cradle 200. By enclosing the second end of the flashlight on three sides, support for the flashlight within the cradle 200 is provided. This allows the cradle 200 to be attached to a surface, such as a wall, with the first end 202 of the cradle being arranged upright. The second end 16 of the flashlight is supported by the enclosed second end 204 of the cradle 200 to prevent the flashlight from falling out from the cradle 200.

Figure 11:
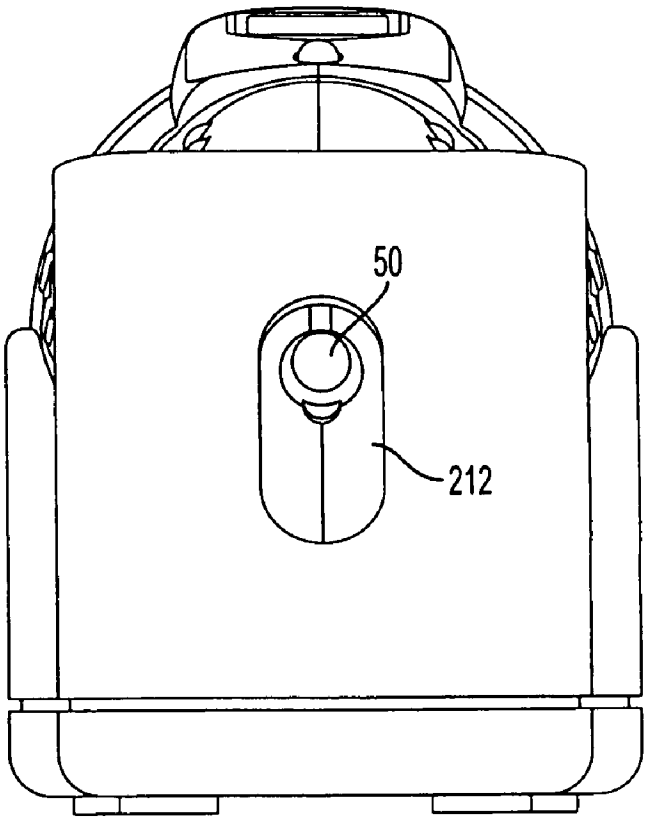
FIG. 11 depicts a rear view of the combination of the flashlight and cradle shown in FIG. 9.
Figure 12:
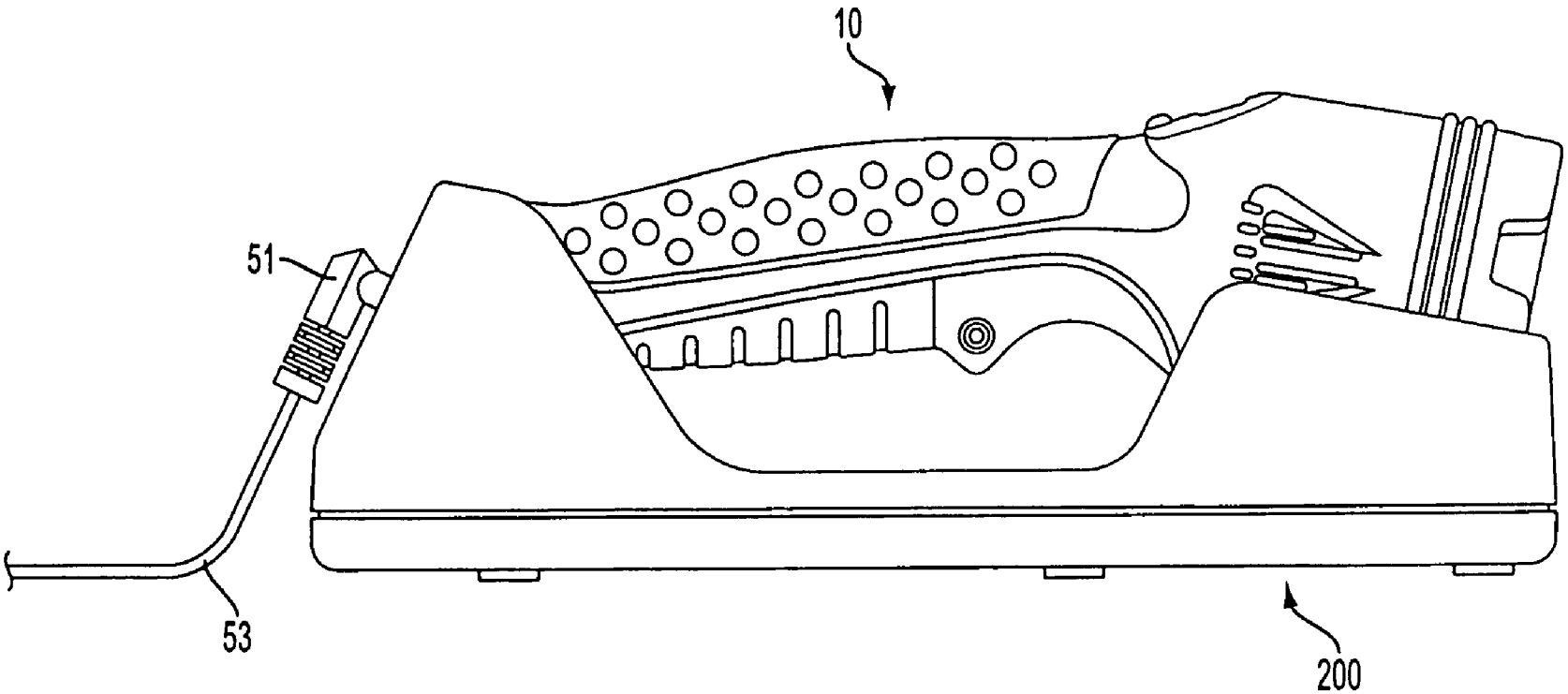
FIG. 12 depicts a side view of the combination of the flashlight and cradle shown in FIG. 9.

The second end 204 of the cradle 200 may define a hole 212, shown in FIG. 11, that allows access to the recharging port 50 on the flashlight. A lead 53 (FIG. 12) from a power supply or standard wall cube can be attached to the port 50 via a pin connector 51 through the hole 212 in the second end 204 of the cradle 200. As shown in FIG. 12, pin connector 51 of the wall cube may be adapted to be removably fixed in hole 212. In this case, whenever flashlight 10 is placed into cradle 200, the pin connector 51 mates with port 50. In this configuration, the flashlight may be connected to a charger every time the flashlight is returned to the cradle.

Figure 13:
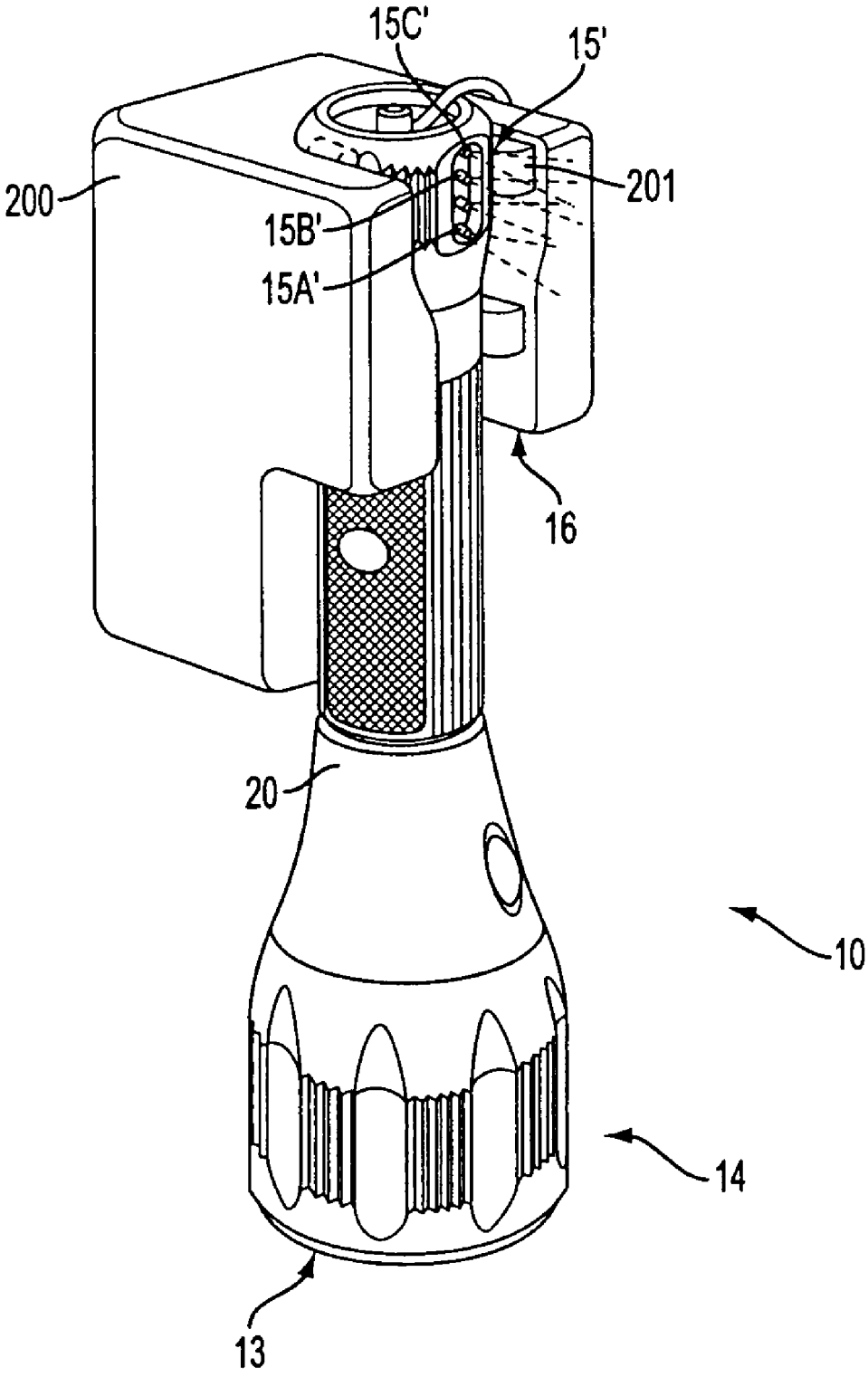
FIG. 13 depicts another exemplary embodiment of a combination of a flashlight and cradle according to the present invention.

The flat panel 206 of the cradle 200 may be spaced from the body portion 20 of the flashlight 10 when the flashlight 10 is resting in the cradle as shown in FIG. 13. This provides space for a user's hand to grasp the flashlight when inserting and removing the flashlight from the cradle. The first end 202 of the cradle 200 may include a recess 214 adapted to receive the support portion 74 on the first end 14 of the flashlight 10.

FIG. 13 illustrates another embodiment of a combination of a flashlight and a cradle according to the invention. Flashlight 10 includes a flashlight body 20' having first end 14' and a second end 16'. Flashlight body 20' is an elongated cylinder with a head formed at the first end 14'. First light source 13' may be provided at first end 14'. Second light source 15' may be provided at second end 16'. Light from the second end 16' maybe directed in a single radial direction, at substantially a right angle to the body 20 as shown, or in multiple radial directions (not shown). Here, the second light source includes one, or LEDs 15A', 15B', 15C' that may be arranged in a row. A lens may be arranged over the LEDs so that the LEDs project their light at substantially a right angle to the flashlight body. The lens can be adapted as desired to create a focused beam or unfocused, less defined beam. Contacts (not shown) may be provided at the second end 16' of the housing opposite the second light source 15'.

Cradle 200' may be provided to hold flashlight 10'. Cradle 200' includes a U-shaped recess that is configured to receive the second end 16' of the flashlight. Charging contacts (not shown) may be provided in the cradle to mate with the contacts on the second end 16' of the flashlight. Spring-loaded tabs 201 may be provided on either side of the U-shaped recess to hold the flashlight 10' in the cradle 200'. The cradle 200' may include a recharging circuit adapted to receive AC power input and provide a recharging current to the charging contacts. The recharging circuit may include an AC connector, such as an AC plug, so that the cradle may be plugged into a typical wall outlet. Recharging power is then provided to the flashlight 10' via the charging contacts on the cradle and the contacts on the second end 16' of the flashlight body.

The flashlight 10' may include an auto-power on feature. The flashlight 10' may include a means to detect when the flashlight is in the cradle 200' and is receiving recharging power. If the recharging power in interrupted, one of the light sources may be activated. For example, the LEDs 15' in the second end 16' of the flashlight may be automatically activated whenever the flashlight 10' is in the cradle 200, plugged into a power source and the power source is interrupted. For example, a light source may be activated when the flashlight is recharging and there is power outage. The light source is powered by the flashlight power supply. The light source provides a night-light function and allows a user to locate the flashlight in the dark. Any light source may be activated via the auto-power feature. For example, the CCFL in the embodiment shown in FIG. 6 may be activated by the auto-power on feature.

A controller is provided to control the operation of the multi-function flashlight discussed above. An integrated circuit such as a programmable microprocessor, a custom wired integrated circuit or discrete circuit components can be used as a controller. The controller can control the operation of a plurality of light sources, such as those used in the flashlight described above. The controller may also control the charging of the rechargeable power supply for the flashlight, and perform diagnostics and status checks on the power supply. The controller and associated circuitry described below can also be used as a controller in other battery powered lighting devices, such as spotlights, portable lamps, etc.

Figure 14:
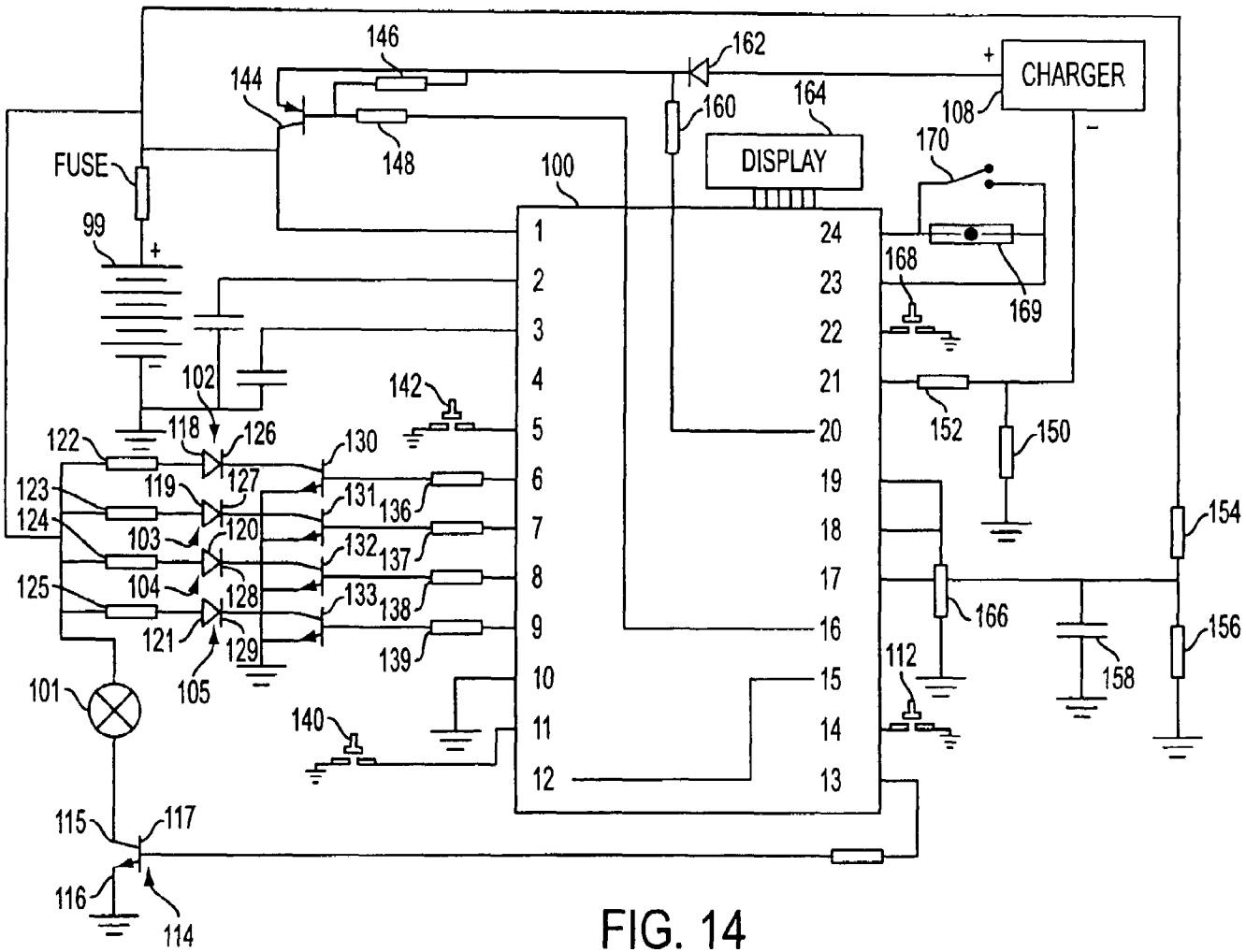
FIG. 14 depicts a schematic of an exemplary embodiment of a a control circuit for use in a flashlight according to the present invention.

FIG. 14 is a block diagram of an example of a controller 100 and associated circuitry that may be used for controlling the operation the flashlight described above. In this example, the flashlight includes a battery 99 that provides power to an incandescent lamp 101 and to a second light source, such as a plurality of LEDs 102-105. The battery 99 is chargeable by connecting it to a charger 108. The charger 108 can be internal to the flashlight or an external charger such as a known AC/DC converter/charger wall cube. If internal to the flashlight, the AC/DC charger can be in the form of a known UL approved wall cube, having a fire rated housing with AC prongs adapted for connection to an AC receptacle. This embodiment is not illustrated. See co-pending U.S. patent application Ser. No. 10/731,113, incorporated herein by reference for further details on this aspect of the invention. Controller 100 controls the operation of the flashlight based in part on input from a user. A push button or other type of switch may be provided for the user to select modes of operation for the flashlight.

In the embodiment shown in FIG. 14, a momentary push button switch 112 is connected to pin 14 of the controller 100 and is used to control the operation of the incandescent lamp 101. Depressing the switch 112 can adjust the brightness of the incandescent lamp 101, as well as turn lamp 101 on and off. The controller 100 is programmed to respond to input from the switch 112 to control the power supplied to the incandescent lamp 101. Transistor 114 is connected in series with lamp 101 and directly drives the lamp 101. Transistor 114 may be, for example, a MOSFET or a bipolar junction transistor. One terminal 115 of transistor 114 is coupled to the lamp 101 and a second terminal 116 is coupled to ground. A control terminal 117 of transistor 114 receives a control signal from the controller 100. The control signal places transistor 114 in a conducting or a non-conduction state, selectively allowing current to flow through the lamp 101 and illuminate it. A resistor may be provided to limit the current provided to the control terminal as required.

The control signal provided to control terminal 117 from the controller 100 is preferably a pulse width modulated signal with a pulse width that extends from 0% to 100%. By varying the pulse width of the control signal, the brightness of the lamp 101 can be controlled in a known manner. U.S. patent application Ser. No. 10/345,154, which is incorporated herein by reference, teaches a method and circuit for pulse width modulation. Additionally, the transistor 114 should be selected such that it never operates in its linear mode, resulting in highly efficient operation.

Other ways to provide brightness control of the lamp 101 are also possible. For example, a potentiometer or a sample/hold method can be used. A potentiometer may be desired if the lamp 101 is used in a table lamp that only requires a dimming function. The potentiometer is connected to the controller 100 to control the lamp's brightness.

Controller 100 can also be used to control the modes of operation of the LEDs 102-105. In the example illustrated in FIG. 14, four LEDs 102-105 are provided, however, any number could be used. Anodes 118-121 of the LEDs 102-105 are each coupled to the positive side of battery 99 via resistors 122-125, respectively. The resistance of the resistors 122-125 may be varied to control the current flow through the LEDs 102-105 so that the LEDs 102-105 can be used with a variety of battery sizes simply by changing the resistance values. Cathodes 126-129 of the LEDs are coupled to transistors 130-133, respectively.

Transistors 130-133 are used to drive the LEDs 102-105. One terminal of each of the transistors 130-133 is coupled to its respective LED and another terminal is coupled to ground. A control terminal of each transistor 130-133 receives a control signal from the controller 100. Resistors 136-139 may be coupled to the control terminals of the transistors 130-133, respectively, to limit the current flowing therethrough. Each transistor 130-133 may be supplied with a different control signal so that the LEDs 102-105 can be operated independently from each other. Thus, the LEDs 102-105 can be illuminated in different modes, such as flashing on and off together, individually or in a pattern. The LEDs may be illuminated in combination with the incandescent lamp 101.

The controller 100 may be a custom designed integrated circuit, discrete circuit components or a microprocessor programmed to control the different lighting combination. A user selects a desired pattern via input through a selector. Here two switches 140, 142 are provided to control the modes of operation of the LEDs 102-105. Switch 142 is used to select a standard mode or a pattern mode of operation. Switch 140 is used to select a particular pattern if the pattern mode of operation is selected. The different modes of operation may cause different ones or combinations of the plurality of light sources to be illuminated. Of course, the same functionality can be achieved using one or more switches.

In addition to controlling the operation of light sources, the controller 100 may be programmed to control a charging operation of battery 99. A charging current is supplied from charger 108. Transistor 144 is coupled in series with the battery 99 and provides a current path for the charging current from the charger 108 to the positive terminal of the battery 99. Resistor 146 is coupled between the control terminal of transistor 144 and the charging current supply. Resistor 148 is coupled between the control terminal of transistor 144 and pin 16 of the controller 100. Resistor 146 biases transistor 144 off and resistor 148 biases it on from the output provided at pin 16. The transistor 144 thus operates in a switch mode manner, either on or off, and dissipates little heat. The negative return path for the charging current is via resistor 150, which is coupled between ground and the charger 108. Resistor 150 establishes the maximum charging current level on a cycle-by-cycle basis. The voltage at the high side of the resistor 150 is coupled to resistor 152 to limit the current supplied to pin 21 of the controller 100.

The controller 100 can control the termination of the charging process and taper the charging curent as the charging process progresses. Feedback from the battery 99 is provided to the controller 100. Based in part on the feedback, the controller 100 controls the charging process. For example, resistors 154 and 156 form a feedback circuit from the battery 99 to the controller 100. Resistor 154 is coupled between the positive terminal of the battery 99 and pin 17 of the controller 100. Resistor 156 has one terminal coupled to pin 17 and to resistor 154 and a second terminal coupled to ground. The resistors 154, 156 thus form a voltage divider supplying a proportional amount of the voltage of the battery 99 to pin 17 of the controller 100. Based on the value of the signal supplied to pin 17, the controller 100 can determine the charge of battery 99 and control the transistor 144 accordingly. Capacitor 158 may be provided to stabilize the voltage at pin 17. Resistors 154, 156 may be thought of as a programmable divider. Simply by changing the value of the resistors, a variety of different battery voltages can be handled.

When the flashlight batteries are being recharged resistor 160 provides a signal to pin 20 of controller 100. In response to this signal, controller 100 can lock out operation of the flashlight during the charging operation. A diode 162 is provided to prevent a current flow from the battery 99 back to the charger 108 in the event of a failure at the charger.

The controller 100 can also monitor the status of the battery 99. The status information is conveyed to the user via display 164. The controller 100 receives battery status information via resistor 166, which is coupled to pins 18 and 19 of the controller. Resistor 166 forms a voltage divider with the controller's internal resistor. This voltage divider effectively provides a scaled down version of the battery voltage to pins 18 and 19 of the controller 100. Based on the input received at pins 18 and 19, the controller 100 can determine the status of the battery. Another push button switch 168 can be coupled to the controller 100 for the user to activate the battery monitoring function. Depressing the switch 168 a different number of times results in different information being shown on the display 164. For example, depressing switch 168 once causes the controller 100 to display the charge remaining on the battery, depressing the switch 168 twice displays an estimated amount of time of operation of the first light source, depressing the switch 168 three times displays the estimated amount of time of operation using the second light source, etc. The functionality of the various switches may be combined into a single switch. Additionally, the controller 100 may be programmed to display other kinds of information to the user.

The controller 100 can also be programmed to provide an automatic turn off or battery saver function for the flashlight. In this case, the flashlight controlled by the controller 100 is provided with a tilt switch 169. When the flashlight is moved, as is the case during normal handheld operation of the flashlight, the terminals of the tilt switch 169 randomly short with the movement. The controller 100 receives a signal when the terminals short, indicating the flashlight is in use. When the flashlight is not being moved, the terminals of the tilt switch 169 do not short and no signal is provided to the controller 100. When a signal is not received from the tilt switch 169 for a predetermined period of time, the controller 100 determines the flashlight is not in use and places the flashlight in a sleep mode, disabling any light sources that are currently on. The controller 100 then waits for an input signal from one of the control switches to begin operation of the flashlight.

The battery saver function can be by-passed as desired. This is useful if the flashlight supported by the lens assembly 18 and the second light source is used in a hands free manner as described above. A switch 170 is arranged to by-pass the tilt switch 169. The switch 170 connects the terminals of the tilt switch 169 to provide an indication that the flashlight is in use even thought the flashlight is not moving. Accordingly, the switch 170 should not be of the momentary pushbutton type. The switch 170 should be a switch type, for example a sliding switch, that can selectively establish a short circuit across a tilt switch, providing the signal indicating flashlight use to the controller.

Figure 15:
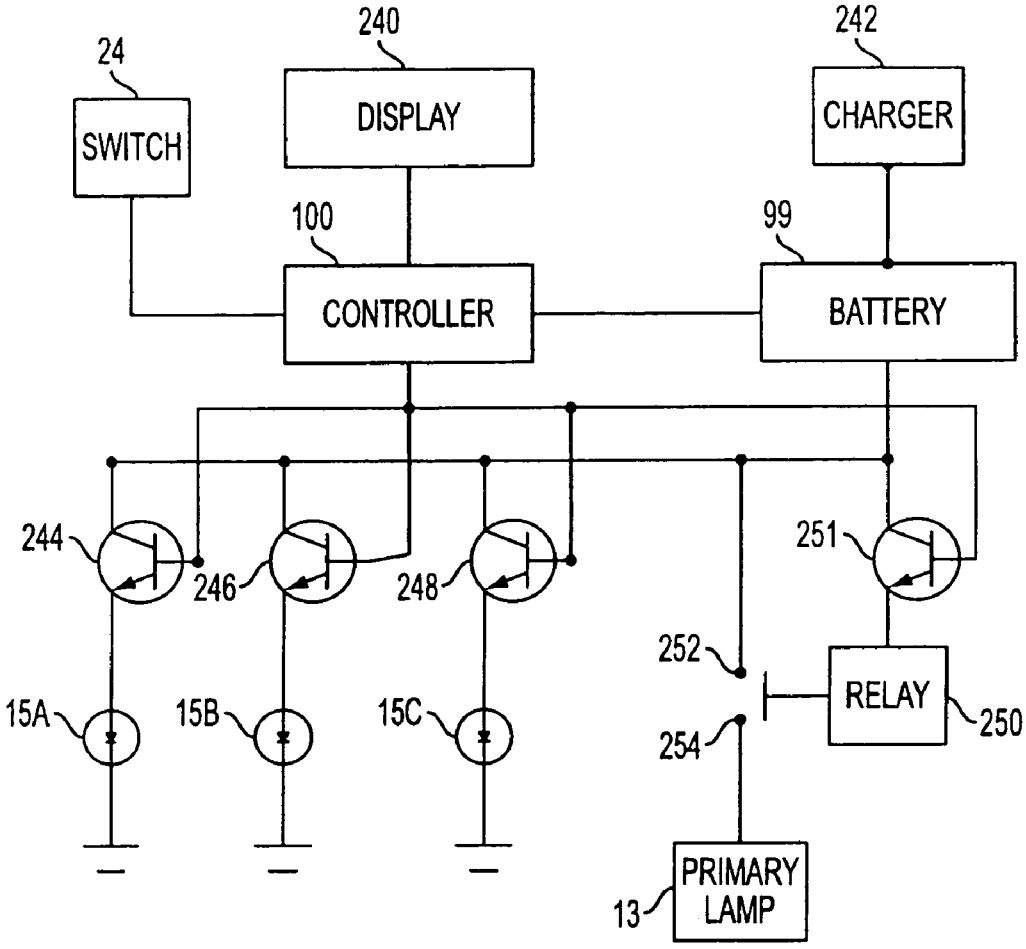
FIG. 15 depicts a schematic of another exemplary embodiment of a control circuit for use in a flashlight according to the present invention.

FIG. 15 illustrates a block diagram of a circuit according to another embodiment of the invention. The circuit includes a controller 100'. The controller is coupled to switch 24, display 240, battery 99, recharging circuit 242, the first light source 13 and second light sources 15A, 15B, 15C. In the embodiment illustrated, the first light source 13 is an incandescent lamp and the second light source includes three LEDs. The lamp and LEDs draw different current or different power from the battery when illuminated. The illumination of the first light source 13 and the second light source 15 is controlled via the controller 100'. A user actuates switch 24 in order to illuminate the desired light source. Any combination of light sources is possible in different modes of operation. In order to illuminate the LEDs, the controller 100' provides an enable signal to a switch, such as a transistor that is connected in series with the desired LED. Each of the LEDs 15A-15C is preferably connected in series with different transistors such that the LEDs can be illuminated and controlled separately. For example, LED 15A is connected in series with transistor 244, LED 15B is connected in series with transistor 246, and LED 15C is connected in series with transistor 248. When control electrodes for each of the transistors receive the enable signal, the respective transistor is placed into a conducting state. Current from battery 99 then selectively flows through the diodes 15A-15C and the diodes are illuminated.

Illumination of the incandescent lamp 13 is also controlled via the controller 100'. A relay 250 may be used to control current flow through the incandescent lamp 13. The relay 250 completes a circuit path that allows current flow through the lamp. A switch such as transistor 251 is provided to enable current flow through the relay 250. When the controller 100 provides an enable signal to a control electrode of the transistor 251, circuit flow through a coil in the relay 250. This causes the relay 250 to close contacts 252, 254 and allow current flow through the incandescent lamp 13, causing the lamp to illuminate.

Switch 24 is activated by a user in order to control the illumination of the various light sources of the flashlight. Activating switch 24 a different number of times illuminates the first and second light sources in different combinations or modes of operation. The controller receives an indication of the activation of the switch 24 and provides enable signals to transistors appropriately. For example, activating the switch 24 one time illuminates only the incandescent lamp 13. Activating the switch two times in succession activates one of the LEDs of the second light source, activating the switch three times in succession simultaneously illuminates two LEDs of the second light source, activating the switch four times in succession illuminates all three LEDS in the second light source, and activating the switch five times in succession illuminates the first light source along with all three LEDS of the second light source. Of course, different combinations of light sources and control functions will be apparent to one skilled in the art and can also be provided.

As mentioned above, the controller 100 can monitor the status of the battery 99. The battery status can be shown on display 240. The display 240 may be a liquid crystal display and conveys information regarding the operation of the flashlight and battery status to the user. The information provided to the user can include an indication that the charger is plugged into the flashlight but is not receiving AC power from a power source, that the flashlight is recharging, that the flashlight recharging operation is complete, and battery charge information as well as other status information.

The controller 100' can also determines the remaining operation time of the flashlight depending on the mode of operation of the flashlight. As mentioned above, the first and second light sources can be illuminated individually or in different combinations. The controller can dynamically determine the approximate operating time of the flashlight depending upon the current battery charge and which light sources are in use. For example, when the flashlight is activated to illuminate only the first light source, the number of minutes that the flashlight can be operated in that mode can be determined by the controller 100 and provided to the user via the display 240. In a similar manner, as the user selects the different modes of operation of the flashlight, for example illuminating, one, two or three of the LEDs or illuminating both the first and second light sources simultaneously, the remaining operation time in the selected mode is shown on the display. This can be done by indicating the number of minutes that the batteries can power the flashlight in the selected mode of operation based on the instantaneous charge level and the current drawn from the battery. As the flashlight is switched between different modes of operation, the controller may dynamically determine the remaining operation time and modify the display accordingly. A user can extend the amount of life of the charge of power supply by selecting a mode of operation with lower power consumption when the charge of the power supply is low.

The display 240 can also include a graphic indication of the charge remaining on the batteries. The graphic indication can take the form of a graphic representation of a battery. As the flashlight batteries become depleted, the graphic display of the battery is modified to indicate the decrease in power supply. For example, the graphic display of the battery may include a battery divided into three sections. As the charge on the flashlight batteries is depleted by one-third, one of the sections of the graphical representation of the battery is eliminated such that only two-thirds of the graphical representation of the battery are visible to a user and so on.

Accordingly, a flashlight and a controller for a light source are provided. The flashlight and controller provide a single, multi-function light source that is simple to manufacture and use.

The embodiments illustrated and discussed in this specification are intended only to teach those skilled in the art the best way known to the inventors to make and use the invention. Nothing in this specification should be considered as limiting the scope of the present invention. All examples presented are representative and non-limiting. The above-described embodiments of the invention may be modified or varied, without departing from the invention, as appreciated by those skilled in the art in light of the above teachings. For example, the functions activated by the different switches described above can also be activated by a single switch. It is therefore to be understood that, within the scope of the claims and their equivalents, the invention may be practiced otherwise than as specifically described.

What is claimed is:

1. A flashlight, comprising:

a housing supporting a plurality of light sources;

a power supply positioned in the housing, having a charge, and selectively couplable to the light sources;

a controller positioned in the housing and configured to receive user input, determine a selected mode of operation from a plurality of available modes of operation based on the user input, the modes of operation each including different light sources to be illuminated, to couple the power supply to selected light sources and to determine a remaining operation time based on the charge of the power supply and the selected mode of operation, the remaining operation time indicating an amount of time the selected light sources for the selected mode of operation can be illuminated based on the charge of the power supply; and a graphic display arranged on the housing and controlled by the controller to indicate the remaining operation time.

2. The flashlight of claim 1, wherein at least two of the light sources draw different current or power per unit of time.

3. The flashlight of claim 1, wherein the plurality of light sources include at least one of incandescent, fluorescent, halogen, and xenon lamps and LCDs, LEDs, and electroluminescent panels.

4. The flashlight of claim 1, wherein the power supply is rechargeable and the controller determines a recharging status of the rechargeable power supply.

5. The flashlight of claim 4, wherein the recharging status includes at least one of an indication that a recharger is plugged into the flashlight but is not receiving power AC, that the flashlight is recharging, that the flashlight recharging operation is complete, and of a charge of the power supply.

6. The flashlight of claim 5, wherein the plurality of light sources comprises a plurality of light emitting diodes (LEDs) and the controller activates the LEDs when the recharger is plugged into the flashlight and power from the recharger is interrupted.

7. The flashlight of claim 5, wherein the plurality of light sources includes a CCFL disposed on the housing and the controller activates the CCFL when the recharger is plugged into the flashlight and power from the recharger is interrupted.

8. The flashlight of claim 1, wherein the housing has a head disposed at a first end, a second end opposite the first end, and a body adapted to contain the power supply arranged between the first end and the second end;

a first of the plurality of light sources is disposed at the head of the housing; and a second of the plurality of light sources disposed at the second end of the housing to project their light in one direction substantially perpendicular to light from the first if the plurality of light sources.

9. The flashlight of claim 8, wherein the second of the plurality of light sources comprises a plurality of light emitting diodes (LEDs) disposed at the second end of the housing.

10. The flashlight of claim 9, further comprising a magnifying lens disposed over the LEDs.

11. The flashlight of claim 1, wherein the controller is configured to dynamically determine the remaining operation time as the modes of operation are changed.

12. The flashlight of claim 1, wherein the light sources are illuminated individually or simultaneously.

13. The flashlight of claim 1, further comprising a switch disposed on the housing and coupled to the controller, actuation of the switch sending a signal to the controller to cause the light sources to be illuminated.

14. The flashlight of claim 4, further comprising a charging circuit adapted to be connected to a power source to charge the power supply.

15. The flashlight of claim 14, further comprising a port adapted to connect the power supply to an external charger.

16. The flashlight of claim 1, further comprising a lens ring at a first end of the housing, the lens ring having a surface to stand the flashlight upright on the first end.

17. In a flashlight comprising a housing supporting a plurality of light sources; a display arranged on the housing; a power supply disposed in the housing and selectively coupled to the light sources; a controller for controlling the coupling of the power supply to the light sources; and a selector disposed on the housing and coupled to the controller, a method for controlling operation of the flashlight:

receiving a signal from the selector at the controller;

determining a selected mode of operation from a plurality of available modes of operation with the controller based on the signal from the selector, the modes of operation defining different one or combinations of the light sources to be illuminated;

selectively coupling individual ones or combinations of the light sources to the power supply based on the selected mode of operation;

determining a remaining operation time for any mode of operation based on a charge of the power supply and the mode of operation; and causing the remaining operation time for the selected mode of operation to be shown on the display.

18. The method of claim 17, wherein determining the operation time comprises:

determining a charge of the power supply;

determining the light sources currently illuminated; and determining power used by the light sources currently illuminated.

19. The method of claim 17, wherein the plurality of light sources comprise a lamp and three LEDs and further comprising:

illuminating the lamp when the selector is actuated once;

illuminating a first one of the LEDs when the selector is actuated twice in succession;

illuminating a second one of the LEDs when the selector is actuated three times in succession;

illuminating a third one of the LEDs when the selector is actuated four times in succession;

illuminating all of the LEDs when the selector is actuated five times in succession; and illuminating all of the LEDs and the lamp when the selector is actuated six times in succession.

20. The method of claim 17, further comprising showing a graphical representation of the charge of the power supply on the display.

21. The method of claim 17, further comprising receiving the signal from the selector each time the selector is actuated.

* * * * *